US010197031B2

(12) United States Patent
Serra et al.

(10) Patent No.: US 10,197,031 B2
(45) Date of Patent: Feb. 5, 2019

(54) FUEL RAIL ASSEMBLY

(71) Applicant: Continental Automotive GmbH, Hannover (DE)

(72) Inventors: Giandomenico Serra, S. Giuliano Terme (IT); Gisella Di Domizio, San Giuliano Terme (IT); Marco Pasquali, Leghorn (IT)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 0 days.

(21) Appl. No.: 15/286,865

(22) Filed: Oct. 6, 2016

(65) Prior Publication Data

US 2017/0101971 A1 Apr. 13, 2017

(30) Foreign Application Priority Data

Oct. 7, 2015 (EP) ..... 15188686

(51) Int. Cl.
*F02M 55/02* (2006.01)
*F02M 61/14* (2006.01)
*F02M 69/46* (2006.01)

(52) U.S. Cl.
CPC ..... *F02M 55/025* (2013.01); *F02M 61/14* (2013.01); *F02M 69/465* (2013.01); *F02M 2200/8084* (2013.01); *F02M 2200/853* (2013.01); *F02M 2200/856* (2013.01)

(58) Field of Classification Search
CPC ..... F02M 55/02; F02M 55/025; F02M 2200/853; F02M 2200/856; F02M 61/14
See application file for complete search history.

(56) References Cited

U.S. PATENT DOCUMENTS 4,286,563 A * 9/1981 Fahim ..... F02B 75/22 123/469
6,148,797 A * 11/2000 Gmelin ..... F02M 55/025 123/456
6,830,035 B2 * 12/2004 Nishiwaki ..... F02M 61/14 123/470

(Continued)

FOREIGN PATENT DOCUMENTS

CN 1671886 A 9/2005
CN 101806267 A 8/2010

(Continued)

OTHER PUBLICATIONS

Search Report dated Feb. 18, 2016, from EP Patent Application No. EP15188686.8.

(Continued)

*Primary Examiner* — David Hamaoui

(57) ABSTRACT

A fuel rail assembly for an internal combustion engine is disclosed. It comprises a plurality of fuel delivery lines branching off from a fuel rail, each fuel delivery line hydraulically coupling one fuel injector to an outlet port of the fuel rail. Each fuel delivery line has a one-piece pipe which extends from an outlet port of the fuel rail to the respective fuel injector. The pipe has a cylindrical connection section adjoining the respective outlet port and a cylindrical injector cup section in which a fuel inlet portion of the respective fuel injector is received. The connection section and the injector cup section have different hydraulic diameters.

14 Claims, 3 Drawing Sheets

(56) References Cited

U.S. PATENT DOCUMENTS 6,889,660 B2 * 5/2005 Usui ..... F02M 55/004 123/456
7,455,050 B2 * 11/2008 Xu ..... F02M 55/005 123/468
7,556,022 B1 * 7/2009 Doherty ..... F02M 55/004 123/456
7,765,984 B2 * 8/2010 Fuerst ..... F02M 55/025 123/456
7,810,471 B2 * 10/2010 Zdroik ..... F02M 61/14 123/456
8,215,289 B2 * 7/2012 Fischer ..... F02M 61/14 123/470
8,458,904 B2 6/2013 Zdroik et al.
8,899,274 B1 * 12/2014 Grosch ..... B29C 65/483 138/109
9,133,799 B2 * 9/2015 Takasaki ..... F02M 55/025
2002/0100456 A1 8/2002 Panasuk et al.
2016/0177903 A1 * 6/2016 Di Domizio ..... F02M 61/14 123/470
2017/0138312 A1 * 5/2017 Caley ..... F02M 21/0245

FOREIGN PATENT DOCUMENTS

| | | | |
|---|---|---|---|
| CN | 202082024 | U | 12/2011 |
| DE | 19826011 | A1 | 12/1998 |
| EP | 2607678 | A | 6/2013 |
| EP | 2690281 | A1 | 1/2014 |
| JP | 2007016668 | A | 1/2007 |
| JP | 2013072416 | A | 4/2013 |

OTHER PUBLICATIONS

Chinese Office Action dated Aug. 3, 2018 for corresponding Chinese application no. 201610867228.X.

* cited by examiner

Fig. 1B
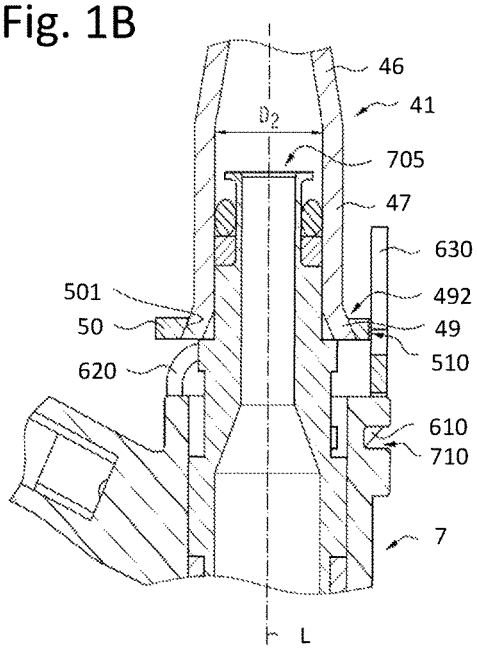
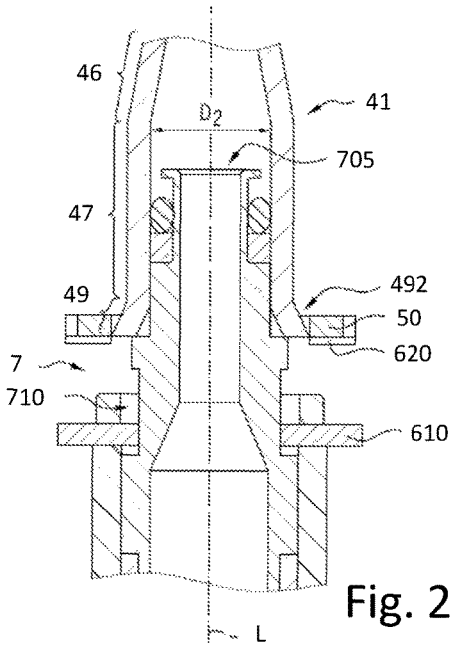
Fig. 2B
Fig. 1A
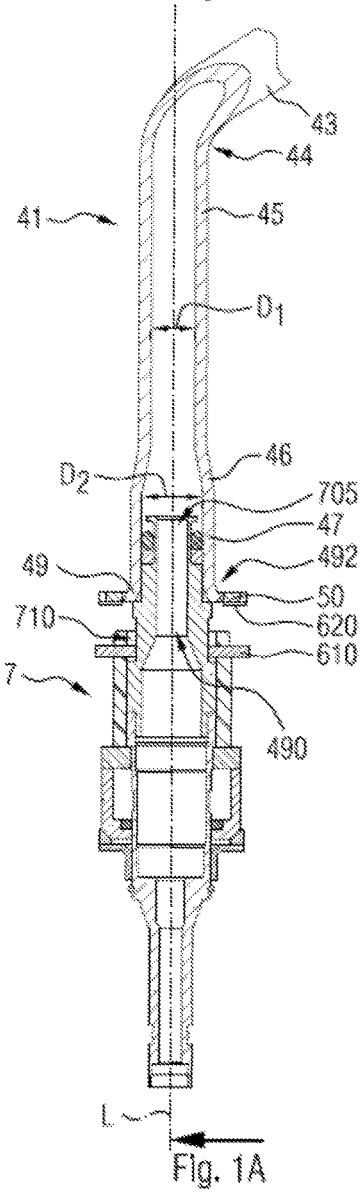
Fig. 1A
Fig. 2A

FUEL RAIL ASSEMBLY

CROSS REFERENCE TO RELATED APPLICATION

This application claims priority to and the benefit of European Patent Application 15188686.8, filed Oct. 7, 2015. The content of the above application is incorporated herein by reference in its entirety.

FIELD OF THE INVENTION

The present disclosure relates to a fuel rail assembly for an internal combustion engine.

BACKGROUND

A fuel rail assembly is, for example, disclosed in EP 2 607 678 A1. Fuel rail assemblies have generally a fuel rail for storing fuel and are configured for delivering fuel from the fuel rail to a plurality of injectors which are hydraulically coupled to the fuel rail.

SUMMARY

It is an object of the present disclosure to specify a fuel rail assembly with a particularly simple and/or cost effective connection between the fuel rail and the injectors.

This object is achieved by a fuel rail assembly having the features of claim 1. Advantageous embodiment and developments of the fuel rail assembly are specified in the dependent claims, in the following description and in the drawings.

A fuel rail assembly for an internal combustion engine is disclosed. The fuel rail assembly comprises an elongated tubular fuel rail and a plurality of fuel injectors. The elongated tubular fuel rail is in particular a tubular fuel reservoir. Preferably, it is a straight tube. The fuel rail is in particular made of a metal or an alloy.

Preferably, fuel is supplied under high pressure into the fuel rail, in particular by a fuel pump, and stored in the fuel rail for being dispensed into the internal combustion engine by the plurality of fuel injectors. The fuel injectors are in particular operable to inject the fuel directly into respective combustion chambers of the combustion engine.

The fuel rail has a plurality of outlet ports. The outlet ports can comprise or consist of bores in the fuel rail. In addition, each outlet ort can comprise an outlet port tube. The outlet port tube is in particular an individual part—preferably a metal tube—which is attached to the fuel rail. Preferably, it is attached to an outer surface of the fuel rail. In particular, it is shaped in such fashion that its position on the outer surface is adjustable during assembly of the fuel rail assembly. For example, during manufacturing of the fuel rail assembly, the fuel rail may be provided with the bores for dispensing fuel out of the fuel rail. The position of the bores may be predetermined according to the engine configuration for which the fuel rail assembly is produced and may vary from fuel rail to fuel rail. The outlet port tubes are shaped such that they can be positioned laterally surrounding a respective bore of the fuel rail, independent on the position of the bore in the fuel rail. The outlet port tubes are preferably attached to the outer surface of the fuel rail by means of a brazed and/or welded connection. The outlet port tubes are preferably short tubes. This means in particular that the dimension of the respective tube in the flow direction is twice as large or less, preferably as large or less and in particular half as large or less than its dimension perpendicular to the flow direction, in particular than its outer diameter.

The fuel rail assembly further has a plurality of fuel delivery lines. The fuel delivery lines branch off from the fuel rail. Each fuel delivery line hydraulically couples one of the fuel injectors to one of the outlet ports. That means in particular that each of the fuel delivery lines is assigned to one, and only one, of the injectors and to one, and only one, of the outlet ports. In the following, only one of the fuel delivery lines is described in detail. However, the fuel delivery lines are preferably of identical type. The fuel delivery lines may be arranged subsequently to one another along an elongation direction of the tubular fuel rail.

The fuel delivery line has a one-pieced pipe. The expression "one-pieced" means in the present context that the pipe is not assembled from a plurality of parts which are connected to one another during the manufacturing process of the pipe. Rather, the pipe is a single workpiece or made from a single workpiece. In particular, the pipe is a metal tube. In particular it consists of a stamped, deep drawn, extruded or cold-formed metal tube.

The pipe has a cylindrical connection section and a cylindrical injector cup section. The connection section and the injector cup section are integral portions of the pipe and represented by different regions of the pipe. The cylindrical connection section is positioned adjacent to the respective outlet port and in particular adjoins the outlet port. For example, it is received in the outlet port tube and/or abuts the outer surface of the fuel rail so that it laterally surrounds the bore of the outlet port. A fuel inlet portion of the respective fuel injector is received in the injector cup section of the pipe. In particular, the injector cup section axially overlaps and laterally surrounds the inlet portion with respect to a longitudinal axis of the fuel injector.

The connection section and the injector cup section have different hydraulic diameters. In particular, the hydraulic diameter of the injector cup section is larger—for example at least 20% larger, preferably at least 50% larger than the hydraulic diameter of the connection section. In an embodiment in which the pipe has a circular cross-section, the hydraulic diameters are represented by the diameter of the inner circumferential surface of the circumferential wall of the pipe in the respective sections.

With advantage, the fuel delivery lines of the subject fuel rail assembly have a particularly small number of brazing or welding joints. In particular, there is no need to fix a separate injector cup to the pipe for coupling with the fuel injector. In particular by using a production process as stamping, deep drawing or cold-forming, the geometry of the pipe is simply and cost efficiently adaptable to different engine geometries.

In one embodiment, a reinforcement ring is fixed to the pipe adjacent to the injector cup section. Preferably, the reinforcement ring is fixed to the pipe by means of a brazed and/or welded connection. Alternatively or additionally, it can be fixed to the pipe by means of a threaded connection. It is also conceivable that the reinforcement ring is fixed to the pipe by means of a press-fit connection in some embodiments. With advantage, the configuration of the pipe with the injector cup section and the reinforcement ring may be particularly lightweight as compared to designs with conventional injector cups. The connection between the reinforcement ring and the pipe has in particular only a structural function, i.e. it is operable to mechanically fix the reinforcement ring to the pipe. No fluid-tight connection may be necessary.

In one embodiment, the pipe has an end section which is in particular positioned on a side of the cylindrical injector cup section remote from the connection section of the pipe. The end section preferably comprises an opening of the pipe through which opening the respective fuel injector extends into the injector cup section. Further, the end section preferably has an interface with the injector cup section. In an expedient development, the end section tapers from the opening to the interface. In particular, the inner circumferential surface and preferably also the outer circumferential surface of the pipe are conical in the region of the end section.

In one embodiment, the reinforcement ring has a tapering circumferential surface which adjoins the end section. In particular, it adjoins the conical outer circumferential surface of the pipe in the region of the end section. In particular, the displaceability of the reinforcement ring relative to the pipe in direction away from the fuel rail is limited by means of a form-fit and/or force-fit coupling between the tapering circumferential surface of the reinforcement ring and the conical outer surface of the pipe.

With advantage, the tapering end section allows easy centering of the fuel inlet of the fuel injector with respect to the injector cup section. Further, by means of the mechanical interaction between the tapering circumferential surface of the reinforcement ring and the end section, simple and reliable positioning of the reinforcement ring on the pipe is achievable.

In one embodiment, the pipe and the reinforcement ring are made from different materials. Alternatively or additionally, the pipe and the reinforcement ring have different material thicknesses. The material thickness of the pipe is in particular the wall thickness of the pipe, in particular in the region of the injector cup section and/or the end section. The material thickness of the reinforcement ring is in particular given by the thickness of the ring perpendicular to one of its surfaces which is not parallel to a central axis of the ring. In particular, the reinforcement ring is made from a metal sheet. In this case, the material thickness of the reinforcement ring is in particular the thickness of the metal sheet. With advantage, in case of the present configuration of the fuel rail assembly the selection of material and thickness can be made individually for the reinforcement ring and the pipe, in particular its injector cup section. In this way, it is possible to optimize structural and hydraulic properties and achieving at the same time a particular small weight.

In one embodiment, the pipe comprises a cylindrical intermediate section. The intermediate section is positioned between the connection section and the injector cup section. It hydraulically connects the connection section and the injector cup section. The pipe has a bend between the intermediate section and the connection section so that the cylinder axes of the intermediate section and the connection section are not parallel. Preferably, the intermediate section and the connection section have the same hydraulic diameter. In particular, the diameter of the inner circumferential surface of the circumferential wall of the pipe is the same in the connection section and in the intermediate section. In this way, the fuel delivery lines can be easily adapted to different engine configurations by adjusting the position and/or the bending angle of the bend, in particular without changing the geometry of the connection section and the injector cup section. By means of the connection section and the intermediate section with the bend in between, it is particularly easy achieve different predetermined positions of the fuel rail and the fuel injectors with respect to one another for different engine geometries.

In one embodiment, the pipe has a tapering interface region between the injector cup section and the connection section or—if the pipe has the intermediate section—between the injector cup section and the intermediate section. In particular, the hydraulic diameter of the interface region corresponds to the hydraulic diameter of the connection section or the intermediate section, respectively, where the interface region mergers with the connection section or the intermediate section, respectively, and the hydraulic diameter of the interface region corresponds to the hydraulic diameter of the injector cup section where the interface region mergers with the injector cup section. The circumferential wall of the pipe is in particular conical in the interface region. By means of such an interface region, the different hydraulic diameters of the injector cup section and the connection section or the intermediate section, respectively, are particularly simply achievable by means of stamping, deep drawing or cold-forming a metal tube.

In one embodiment, the fuel rail assembly comprises a plurality of spring clips. In particular, one spring clip is assigned to each of the fuel injectors. The spring clip bears against the respective fuel injector and against the corresponding fuel delivery line for biasing the fuel injector away from the pipe or, alternatively, for biasing the fuel injector towards the pipe, in particular with respect to the longitudinal axis of the fuel injector. The spring clip in particular bears against a shoulder of a housing of the fuel injector with one axial end and bears against the pipe and/or the reinforcement ring of the fuel delivery line with its opposite axial end with respect to the longitudinal axis of the fuel injector.

In one embodiment, each spring clip has a ground plate and at least one axially compliant leg projecting from the ground plate. The leg is in particular bent and/or comprises kinks to achieve the axial flexibility. The ground plate is preferably radially compliant and snap-fit connected in a groove of the fuel injector, the groove in particular being comprised by a housing of the fuel injector, to block axial movement of the ground plate relative to the fuel injector with respect to its longitudinal axis. The axially compliant leg preferably bears against the reinforcement ring. A reliable mechanical connection between the spring clip and the fuel delivery line is advantageously achievable with the reinforcement ring.

In one embodiment, the spring clip is rotationally locked relative to the fuel injector. This is achieved in particular by means of the snap-fit connected ground plate in the groove of the fuel injector. The spring clip and the fuel delivery line may expediently have corresponding indexing elements which rotationally lock the spring clip relative to the fuel delivery line. For example, the spring clip has an axially extending pin which is received in a groove or a cutout of the reinforcement ring. In this way, rotational indexing of the fuel injector relative to the fuel delivery line is easily achievable.

Further advantages, advantageous embodiments and developments of the fuel rail assembly will become apparent from the exemplary embodiments which are described below in association with the figures.

BRIEF DESCRIPTION OF THE FIGURES

FIG. 1B shows a detail of FIG. 1B in a larger scale, FIG. 2A shows another longitudinal section view of the fuel rail assembly according to the first exemplary embodiment, FIG. 2B shows a detail of FIG. 2B in a larger scale.

DETAILED DESCRIPTION

In the exemplary embodiments and in the figures, similar, identical or similarly acting elements are provided with the same reference symbols. In some figures, individual reference symbols may be omitted to improve the clarity of the figures.

Figure 1A:
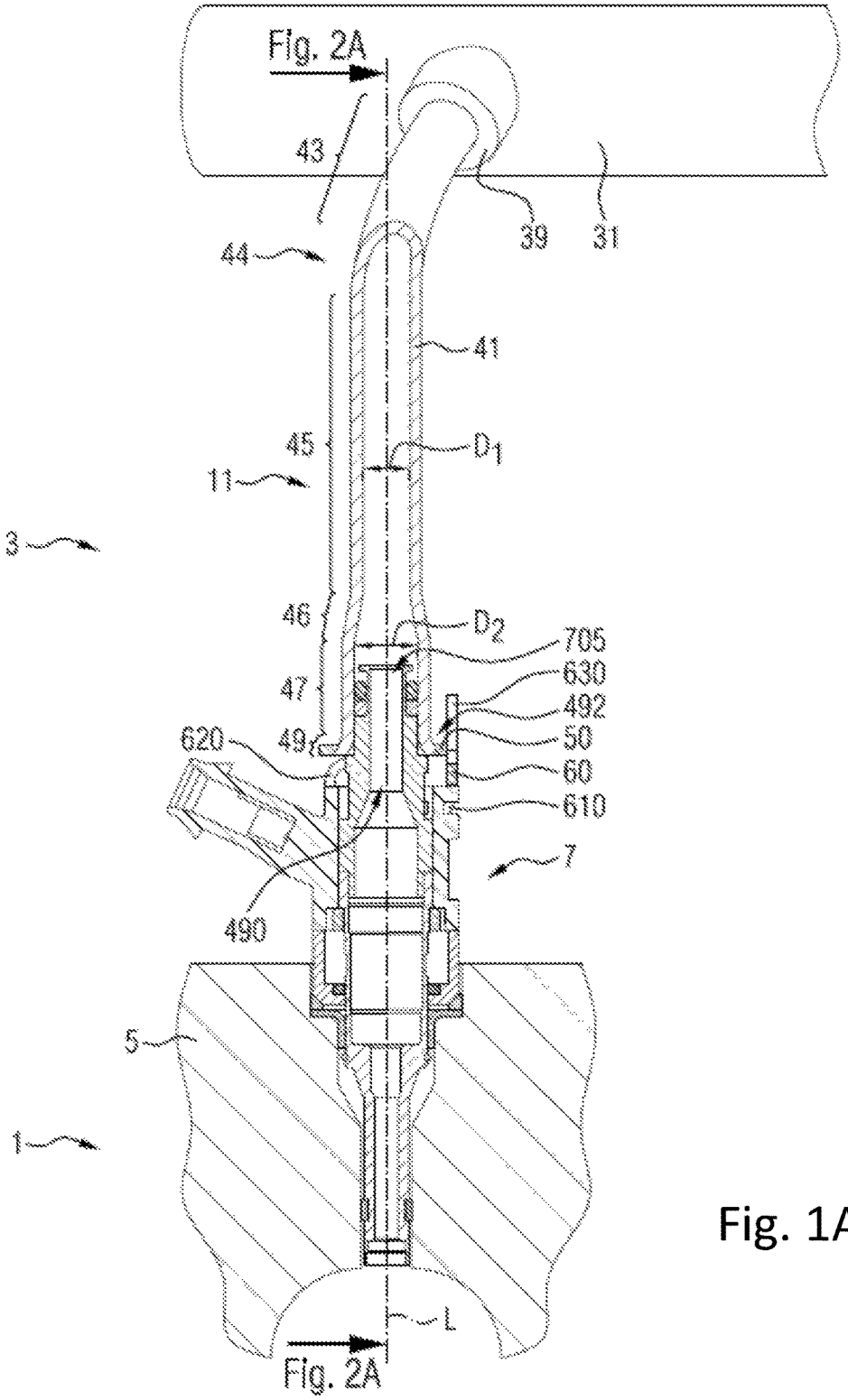
FIG. 1A shows a longitudinal section view of a fuel rail assembly according to a first exemplary embodiment.
Figure 3:
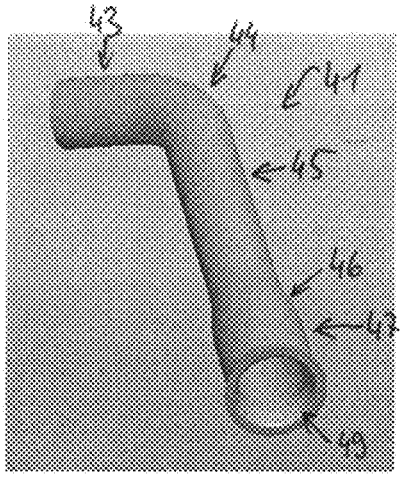
FIG. 3 shows a perspective view of a pipe of the fuel rail assembly according to first exemplary embodiment.
Figure 4:
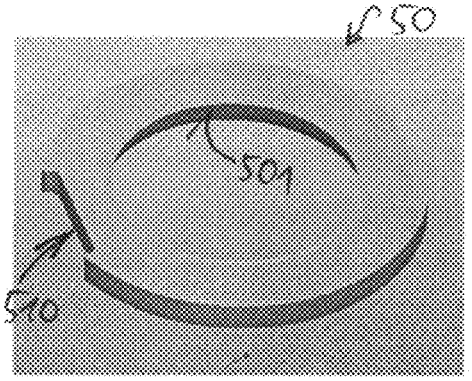
FIG. 4 shows a perspective view of a reinforcement ring of the fuel rail assembly according to the first embodiment.

FIG. 1A shows a fuel rail assembly 3 for an internal combustion engine 1 in a longitudinal section view. FIG. 1B shows a detail of FIG. 1 in an enlarged scale.

The fuel rail assembly 3 comprises an elongated tubular fuel rail 31 and a plurality of fuel injectors 7. The image plane of FIGS. 1A and 1B is parallel to an elongation direction of the tubular fuel rail and to longitudinal axes L of the fuel injectors 7. Only a portion of the fuel rail assembly 3, showing one fuel injector 7 of the plurality of fuel injectors 7, is shown in FIG. 1A.

The fuel injectors 7 are positioned in receptacle bores of a cylinder head 5 of the internal combustion engine 1 so that they are operable to inject fuel directly into respective combustion chambers of the internal combustion engine 1. Each fuel injector 7 is hydraulically and mechanically connected to an outlet port 39 of the fuel rail 31 by means of a fuel delivery line 11.

The fuel rail 31 is metallic; in particular it is made from steel. Fuel is supplied to the fuel rail 31 through an inlet fitting (not shown) on one axial end of the fuel rail 31 with respect to the elongation direction of the fuel rail 31. The opposite axial end of the fuel rail 31 is sealed by an end plug (not visible in FIG. 1A). The fuel rail may be fixed with respect to the engine 1 by means of a fixation lug (not shown). A sensor port tube (not shown) may branch off from the fuel rail 31, in particular for measuring fuel pressure in the fuel rail 31.

The fuel delivery lines 11, of which only one is positioned in the portion of the fuel rail assembly which is visible in FIG. 1A are spaced apart from one another and follow one another in the elongation direction of the fuel rail 31. The fuel rail lines 11 hydraulically couple the fuel rail 31 to the fuel injectors 7. The fuel injectors 7 may also be held in place mechanically by the fuel rail assembly 3.

All fuel delivery lines 11 are of identical construction. In particular, they consist of a pipe 41 and a reinforcement ring 50. The pipes 41 branch off from the fuel rail 31 at respective outlet ports 39 of the fuel rail.

In the present embodiment, the outlet ports 39 each comprise a bore in a circumferential sidewall of the fuel rail 31 and an outlet port tube attached to an outer surface of the circumferential sidewall. The outlet port tube laterally surrounds the bore. In the present embodiment, the lateral dimension of the outlet port tube is larger than its axial dimension, i.e. its dimension in direction of the fuel flow.

Each pipe 41 is a one-piece metal tube which is manufactured, for example, by deep drawing, stamping, cold-forming or molding. The pipe has a connection section 43, a bend 44, an intermediate section 45, an interface region 46, an injector cup section 47 and an end section 49 which follow one another in flow direction of the fuel through the pipe 41 from the fuel rail 31 to the fuel injector 7.

The connection section 43 is shifted into the outlet port tube of the outlet port 39—and in one development also into the bore in the circumferential wall of the fuel rail 31—for hydraulically and mechanically connecting an upstream end of the pipe 41 to the fuel rail 31. The end section 49 has an opening 490 through which the fuel inlet portion 705 of the fuel injector 7 is shifted into the pipe 41 so that the fuel inlet portion 705 axially overlaps the injector cup portion 47 of the pipe 41.

The fuel inlet portion 705 of the fuel injector 7 is circumferentially surrounded by the injector cup portion 47. The fuel injector 7 comprises a sealing element in the region of the fuel inlet portion 705. The sealing element is an elastomeric sealing ring which is held in position relative to a shoulder of the fuel injector 7 by a backup ring in the present embodiment. In the figures, the elastomeric sealing ring and the backup ring are drawn radially oversized so that they overlap with the circumferential wall of the pipe 41 in the figures. In fact, however, the sealing ring and the backup ring are radially compressed in the assembled state so that they are completely laterally surrounded by the circumferential inner surface of the injector cup section 47 of the pipe 41. The oversized representation in the figures is used to indicate the radial compression.

The connection section 43 and the intermediate section 45 and the injector cup section 47 of the pipe 41 are cylindrical. The connection section 43 and the intermediate section 45 have a first hydraulic diameter which is defined by the diameter $D_1$ of the cylindrical inner circumferential surface of the pipe 41 in the connection portion 43 and the intermediate portion 45, respectively. The injector cup section 47 has a second hydraulic diameter which is defined by the diameter $D_2$ of the cylindrical circumferential inner surface of the pipe 41 in the injector cup section 47. The hydraulic diameter of the injector cup section 47 is larger than the hydraulic diameters of the intermediate section 45 and the connection section 43, i.e. $D_2>D_1$.

Between the intermediate section 45 and the injector cup section 47, the interface region 46 is arranged, which is in the shape of a conical shell. The diameter of the inner circumferential surface of the interface region 46 expands from the first diameter $D_1$ at an end of the interface region 46 where it merges with the intermediate section 45 to the second diameter $D_2$ at the opposite end of the interface region 46, where it merges with the injector cup section 47.

At its end remote from the interface region 46, the injector cup section 47 has an interface 492 with the end section 49. The end section is also a conical shell which widens in direction away from the interface 492 with the injector cup section 47 to the opening 490 of the pipe 41. The opening 490 is positioned at an axial end of the end section 49 remote from its interface 492 with the injector cup section 47.

The conical end section 49, the cylindrical injector cup section 47, the interface region 46 and the intermediate section 45 are co-axial with respect to their central axis and also, in the present embodiment, with respect to the longitudinal axis L of the fuel injector 7. In top view along the longitudinal axis L, the fuel injector 7 is positioned laterally displaced relative to the fuel rail 31, in particular in a direction perpendicular to the elongation direction of the fuel rail 31. In order to bridge this offset, the pipe 41 has the bend 44 between the intermediate section 45 and the connection section 43 so that the cylinder axes of the connection section 43 and the intermediate section 45 are at an angle with respect to one another and the connection section 43 bridges the lateral distance between the fuel rail 31 and the fuel injector 7.

The fuel delivery line 11 also has a reinforcement ring 50 which is fixed to the pipe 41 adjacent to the injector cup section 47. Specifically in the present embodiment, the reinforcement ring 50 has a tapering circumferential surface 501 which adjoins the conical outer circumferential surface of the end section 49. The reinforcement ring 50 is brazed and/or welded to the circumferential outer surface of the pipe 41.

In the present embodiment, the reinforcement ring 50 is in the shape of a flat disc. In other words, it is delimited by two parallel surfaces which extend circumferentially around and perpendicular to the central axis of the reinforcement ring 50.

The fuel rail assembly further comprises one spring clip 60 assigned to each fuel injector 7. The spring clip 60 has a ground plate 610 which positioned in a groove 710 of a housing of the fuel injector 7. The ground plate is shaped in particular as a radially compliant fork, which is sized such that it is elastically deformed when the ground plate 610 is shifted into the groove 710 and a snap-fit connection between the ground plate 610 and the fuel injector 7 is established when the ground plate 610 is fully assembled into the groove 710. In this way, axial movement of the ground plates 610 relative to the fuel injector 7 with respect to the longitudinal axis L is blocked.

The ground plate 610 is spaced apart from the pipe 41 and the reinforcement ring 50 in longitudinal direction L. An axially compliant leg 620 of the spring clip 60 extends in curved fashion from the ground plate 610 to the fuel delivery line 11, where it is in contact with a lower surface of the reinforcement ring 50.

The lower surface of the reinforcement ring 50 in particular extends around the opening 490 of the pipe 41 and is preferably in a common plane with the opening 490. The axially compliant leg 620 is dimensioned and shaped in such fashion that it is axially compressed by means of mechanical interaction with the reinforcement ring 50 and with the fuel injector 7 via the ground plate 610 in the assembled state of the fuel rail assembly 3. In this way, the spring clip 60 is operable to press the fuel injector 7 into the receptacle bore of the cylinder head 5, in a direction away from the pipe 41.

The spring clip is 60 is rotationally locked relative to the fuel injector 7, for example by means of lateral flats of the groove 710 and a corresponding shape of the ground plate 610. Further, the reinforcement ring 50 has an indexing element 510, which is in the present embodiment a cutout that extends laterally inwards from an outer circumferential surface of the reinforcement ring 50. The spring clip 60 has a corresponding indexing element 630—in the present embodiment a longitudinally elongated pin—that is received in the cutout of the reinforcement ring 50. In this way, the indexing elements 510, 630 of the reinforcement ring 50 and the spring clip 60 rotationally lock the spring clip 60 relative to the fuel delivery line 11. Consequently, the fuel injector 7 is rotationally locked relative to the fuel delivery line 11 due to the rotational locking between the fuel injector 7 and the spring clip 60 and between the spring clip 60 and the reinforcement ring 50.

Figure 5:
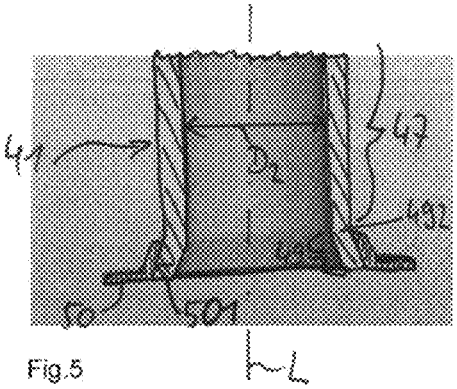
FIG. 5 shows a longitudinal section view of a fuel rail assembly according to a second exemplary embodiment.

FIG. 5 shows one pipe 41 of a fuel delivery assembly 3 according to a second exemplary embodiment in a longitudinal section view. The fuel delivery assembly 3 according to the second exemplary embodiment corresponds in general to that of the first embodiment. The fuel injector 7, which is received with its fuel inlet portion 705 in the injector cup section 47, is omitted in FIG. 5.

Figure 6:
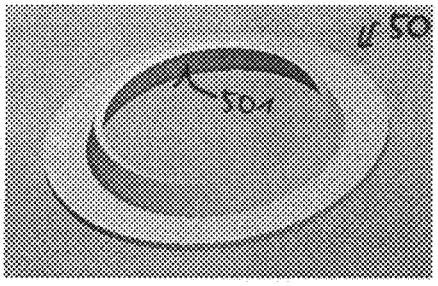
FIG. 6 shows a perspective view of a reinforcement ring of the fuel rail assembly according to the second exemplary embodiment.

The fuel rail assembly 3 according to the second embodiment has a reinforcement ring 50 with a shape which is different from that of the reinforcement ring 50 of the fuel rail assembly 3 according to the first embodiment. FIG. 6 shows the reinforcement ring 50 of the fuel rail assembly 3 according to the second embodiment in a perspective view.

In the second embodiment, the reinforcement ring 50 is not a flat disc. Instead, it has an angled cross-section. To put it differently, the shape of the reinforcement ring 50 is composed of a perforated disc section with upper and lower parallel surfaces facing in longitudinal direction and a conical section which mergers with the inner circumferential edge of the perforated disc section and extends in tapering fashion from the perforated disc in longitudinal direction L. In the present embodiment, the tapering circumferential surface 501 of the reinforcement ring 50 is comprised by the conical section. The conical section may terminate, at its axial end remote from the perforated disc section adjacent to the interface 492 of the section 49 with the cylindrical injector cup section 47.

The invention is not limited to specific embodiments by the description on basis of these exemplary embodiments. Rather, it comprises any combination of elements of different embodiments. Moreover, the invention comprises any combination of claims and any combination of features disclosed by the claims.

What is claimed is:

1. A fuel rail assembly for an internal combustion engine comprising:

an elongated tubular fuel rail with a plurality of outlet ports;

a plurality of fuel injectors;

a plurality of fuel delivery lines branching off from the fuel rail, each fuel delivery line hydraulically coupling one of the fuel injectors to one of the outlet ports;

wherein each fuel delivery line has a one-pieced pipe, the pipe extending from a respective outlet port of the fuel rail to a respective fuel injector so that the pipe hydraulically couples the fuel injector to the fuel rail, and having a cylindrical connection section adjoining the respective outlet port and a cylindrical injector cup section in which a fuel inlet portion of the respective fuel injector is received, the connection section and the injector cup section having different hydraulic diameters;

wherein the fuel rail assembly further comprises a plurality of reinforcement rings, each reinforcement ring fixed to a respective pipe adjacent to the injector cup section, and a plurality of spring clips, each spring clip bearing against a respective pipe and against a respective fuel injector for biasing the fuel injector toward or away from the pipe, wherein each spring clip has a ground plate which is snap-fit connected in a groove of the respective fuel injector to block axial movement of the ground plate relative to the fuel injector with respect to a longitudinal axis of the fuel injector, and an axially compliant leg which extends from the ground plate, is bent and bears against a respective reinforcement ring of the respective pipe so as to compress the axially compliant leg and bias the fuel injector in a direction toward or away from the pipe, and wherein each reinforcement ring comprises an annular disc section with upper and lower parallel surfaces and an inner radial side, and a frustoconical shaped section which extends from the inner radial side of the annular disc section and extends in tapering fashion from the annular disc section.

2. The fuel rail assembly of claim 1, wherein the reinforcement ring is fixed to the pipe by means of at least one of: a brazed connection, a welded connection and a threaded connection.

3. The fuel rail assembly of claim 2, wherein, the pipe has an end section which comprises an opening of the pipe through which the respective fuel injector extends to the injector cup section, the end section has an interface with the injector cup section and tapers from the opening to said interface, and the reinforcement ring has a tapering circumferential surface which adjoins the end section.

4. The fuel rail assembly of claim 3, wherein the pipe and the reinforcement ring are made from different materials.

5. The fuel rail assembly of claim 3, wherein the pipe is at least one of: stamped, deep drawn, extruded and cold-formed metal tube.

6. The fuel rail assembly of claim 3, wherein the pipe further comprises:

a cylindrical intermediate section, which is arranged between the connection section and the injector cup section, and a bend between the intermediate section and the connection section so that cylinder axes of the intermediate section and the connection section are not parallel, wherein the intermediate section and the connection section have the same hydraulic diameter.

7. The fuel rail assembly of claim 6, wherein the pipe has a tapering interface region between the injector cup section and at least one of: the connection section and the intermediate section.

8. The fuel rail assembly of claim 1, wherein each spring clip is rotationally locked relative to the respective fuel injector by the snap-fit connected ground plate in the groove of said fuel injector, and each spring clip and the respective fuel delivery line have corresponding indexing elements, which rotationally lock the spring clip relative to said fuel delivery line.

9. The fuel rail assembly of claim 1, wherein the axially compliant leg of each spring clip bears against the respective reinforcement ring so as to compress the axially compliant leg and bias the fuel injector in an axial direction away from the pipe, relative to a longitudinal axis of the fuel injector.

10. The fuel rail assembly of claim 1, wherein the pipe has an end section which comprises an opening of the pipe through which the respective fuel injector extends to the injector cup section, the end section has an interface with the injector cup section and tapers from the opening to said interface, an inner surface of the frustoconical shaped section contacting an outer surface of the end section.

11. A fuel rail assembly for an internal combustion engine comprising:

an elongated tubular fuel rail with a plurality of outlet ports;

a plurality of fuel injectors;

a plurality of fuel delivery lines branching off from the fuel rail, each fuel delivery line hydraulically coupling one of the fuel injectors to one of the outlet ports;

wherein each fuel delivery line comprises a pipe, the pipe extending from a respective outlet port of the fuel rail to a respective fuel injector so that the pipe couples the fuel injector to the fuel rail, and having a connection section adjoining the respective outlet port and an injector cup section in which a fuel inlet portion of the respective fuel injector is received, the connection section and the injector cup section having different inner diameters;

wherein the fuel rail assembly further comprises a plurality of reinforcement rings, each reinforcement ring fixed to a respective pipe adjacent to the injector cup section, and a plurality of spring clips, wherein each spring clip has a ground plate which is snap-fit connected in a groove of the respective fuel injector to block axial movement of the ground plate relative to the fuel injector with respect to a longitudinal axis of the fuel injector, and an axially compliant leg which extends from the ground plate, is bent and bears against a respective reinforcement ring of the respective pipe so as to compress the axially compliant leg and bias the fuel injector in a direction toward or away from the pipe, wherein the reinforcement ring comprises an annular disc section with upper and lower parallel surfaces and an inner radial side, and a frustoconical shaped section which extends from the inner radial side of the annular disc section and extends in tapering fashion from the annular disc section.

12. The fuel rail assembly of claim 11, wherein the axially compliant leg of each spring clip bears against the respective reinforcement ring so as to compress the axially compliant leg and bias the fuel injector in an axial direction away from the pipe, relative to a longitudinal axis of the fuel injector.

13. The fuel rail assembly of claim 11, wherein the pipe has an end section which comprises an opening of the pipe through which the respective fuel injector extends to the injector cup section, the end section has an interface with the injector cup section and tapers from the opening to said interface, and an inner surface of the frustoconical shaped section contacts an outer surface of the end section.

14. The fuel rail assembly of claim 11, wherein each spring clip is rotationally locked relative to the respective fuel injector by the snap-fit connected ground plate in the groove of said fuel injector, and each spring clip and the respective pipe have corresponding indexing elements, which rotationally lock the spring clip relative to said fuel delivery line.

* * * * *